US011313020B2

(12) United States Patent
Kawabata et al.

(10) Patent No.: US 11,313,020 B2
(45) Date of Patent: Apr. 26, 2022

(54) METHOD AND APPARATUS FOR MANUFACTURING HOT-DIP METAL PLATED STEEL STRIP

(71) Applicant: JFE Steel Corporation, Tokyo (JP)

(72) Inventors: Hironari Kawabata, Tokyo (JP); Soshi Yoshimoto, Tokyo (JP); Takahiko Itagaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 134 days.

(21) Appl. No.: 16/497,501

(22) PCT Filed: Mar. 30, 2018

(86) PCT No.: PCT/JP2018/013738
§ 371 (c)(1),
(2) Date: Sep. 25, 2019

(87) PCT Pub. No.: WO2018/181940
PCT Pub. Date: Oct. 4, 2018

(65) Prior Publication Data

US 2021/0115546 A1 Apr. 22, 2021

(30) Foreign Application Priority Data

Mar. 31, 2017 (JP) ..... JP2017-072883

(51) Int. Cl.
*C23C 2/40* (2006.01)
*C23C 2/00* (2006.01)

(52) U.S. Cl.
CPC ..... *C23C 2/003* (2013.01); *C23C 2/40* (2013.01)

(58) Field of Classification Search
CPC ..... C23C 2/003
See application file for complete search history.

(56) References Cited

U.S. PATENT DOCUMENTS

2001/0022156 A1 9/2001 Iida et al.
2010/0175615 A1* 7/2010 Fukuda ..... C23C 2/003 118/63

(Continued)

FOREIGN PATENT DOCUMENTS

CN 1316541 A 10/2001
CN 101796209 A 8/2010

(Continued)

OTHER PUBLICATIONS

Machine Translation of WO-2009017209-A1.*

(Continued)

*Primary Examiner* — David P Turocy
(74) *Attorney, Agent, or Firm* — RatnerPrestia

(57) ABSTRACT

A method for manufacturing a hot-dip metal plated steel strip having a plated layer formed on the outer surface thereof includes continuously immersing a steel strip in a bath tub that accommodates a molten metal plating bath, causing a sink roll disposed in the bath tub to change the traveling direction of the steel strip, then causing the steel strip to pass through two support rolls formed of a stabilizing roll and a correcting roll disposed above the sink roll but below the surface of the plating bath, and extracting the steel strip out of the bath. A flow regulation plate is disposed so as to cover at least the upper side of a roll body of the stabilizing roll out of the support rolls with a gap between the flow regulation plate and the stabilizing roll, and the flow of the molten metal plating bath directed toward a portion of the steel strip located from the exit of the support rolls to the surface of the plating bath is led toward the lower side of the stabilizing roll via the gap.

3 Claims, 7 Drawing Sheets

(56) References Cited

U.S. PATENT DOCUMENTS

| | | | |
|---|---|---|---|
| 2010/0288463 | A1 | 11/2010 | Takeda et al. |
| 2016/0102393 | A1 | 4/2016 | Schaffrath et al. |

FOREIGN PATENT DOCUMENTS

| | | | | | |
|---|---|---|---|---|---|
| CN | 101821420 | A | | 9/2010 | |
| CN | 201751426 | U | | 2/2011 | |
| CN | 105358728 | A | | 2/2016 | |
| JP | 04247861 | A | | 9/1992 | |
| JP | 2007291473 | A | | 11/2007 | |
| JP | 2010174263 | A | | 8/2010 | |
| JP | 2010185092 | A | | 8/2010 | |
| JP | 2010185115 | A | * | 8/2010 | |
| JP | 2010185115 | A | | 8/2010 | |
| JP | 2013044048 | A | | 3/2013 | |
| JP | 2013224457 | A | | 10/2013 | |
| JP | 2015193879 | A | | 11/2015 | |
| JP | 2016156077 | A | | 9/2016 | |
| WO | 2009017209 | A1 | | 2/2009 | |
| WO | WO-2009017209 | A1 | * | 2/2009 | ..... C23C 2/20 |

OTHER PUBLICATIONS

Chinese Office Action with Search Report for Chinese Application No. 201880019949.2 dated Jan. 27, 2021, with Concise Statement of Relevance of Office Action, 11 pages.

Extended European Search Report for European Application No. 18 774 752.2, dated Dec. 17, 2019, 7 pages.

International Search Report and Written Opinion for International Application No. PCT/JP2018/013738, dated May 1, 2018—4 pages.

* cited by examiner

METHOD AND APPARATUS FOR MANUFACTURING HOT-DIP METAL PLATED STEEL STRIP

CROSS REFERENCE TO RELATED APPLICATIONS

This is the U.S. National Phase application of PCT/JP2018/013738, filed Mar. 30, 2018 which claims priority to Japanese Patent Application No. 2017-072883, filed Mar. 31, 2017, the disclosures of each of these applications being incorporated herein by reference in their entireties for all purposes.

FIELD OF THE INVENTION

The present invention relates to a method and apparatus for manufacturing a hot-dip metal plated steel strip.

BACKGROUND OF THE INVENTION

In a continuous galvanizing in which a hot-dip galvanized steel strip is manufactured by using a hot-dip galvanizing bath as a molten metal plating bath and continuously immersing and passing a steel strip in the plating bath, it is known that foreign matter called dross is produced. As a cause of the production of the dross, it is known that when the steel strip is caused to pass through the hot-dip galvanizing bath, eluted iron flowing out of the steel strip reacts with constituent elements (zinc, aluminum) in the hot-dip galvanizing bath to form an inter-metal compound and the zinc is oxidized.

High-density dross having a higher density than that of zinc forms bottom dross (primarily made of Fe—Zn-based alloy), which is precipitated and deposited in the hot-dip galvanizing bath. Conversely, low-density dross having a lower density than that of zinc forms top dross (primarily made of oxidized zinc, Fe—Al-based alloy), which floats up through the hot-dip galvanizing bath to the bath surface.

The two types of dross both adversely affect the quality of the surface of the steel strip when the dross adheres thereto, and it is therefore very important to avoid adhesion of the dross in the plating of a steel strip.

As a prior-art technology for preventing adhesion of the dross, for example, Patent Literature 1 discloses a technology in which a flow regulation plate is placed in a position where the flow regulation plate does not overlap with a sink roll in a top view in such a way that the flow regulation plate faces a strip to be plated that is located between the sink roll and support rolls, and the flow regulation plate leads an accompanying flow, which has been redirected when the support rolls come into contact with the strip to be plated, toward the side below the sink roll or the space between the sink roll and the bottom surface of the tub.

Patent Literature 2 discloses a technology in which a flow regulation plate is placed in the vicinity of the bath surface above a sink roll to control a molten zinc flow.

PATENT LITERATURE

Patent Literature 1: JP-A-2013-44048
Patent Literature 2: JP-A-2013-224457

SUMMARY OF THE INVENTION

The technology disclosed in Patent Literature 1 described above relates to introduction of the flow regulation plate for separation of the accompanying flow, which occurs in association with the passage of the strip to be plated, from flow in the bottom of the bath. According to the technology, lift of the bottom dross can be suppressed, but in a case where the plating is performed in facilities in which the support rolls are disposed in a position within 100 mm from the surface of the plating bath, the top dross floating in a region of the plating bath that is the region from the exit of the support rolls to the surface of the plating bath inevitably adheres to the steel strip. In the technology disclosed in Patent Literature 2, the flow indicated by the reference character (Japanese "katakana" character: ノ\) shown in FIG. 1 (flow that collides in the vicinity of the position where the steel plate comes into contact with the sink roll and is redirected upward) can be so controlled that amount of flow indicated by the reference character (Japanese "katakana" character: 二) (flow redirected in the vicinity of the bath surface toward the support rolls) is reduced, whereby the lift of the dross below of the support rolls can be suppressed. It is, however, difficult for the technology disclosed in Patent Literature 2 to avoid adhesion of the top dross floating in the region from the exit of the support rolls to the bath surface to the steel strip, as in the Patent Literature 1.

An object of the present invention is to propose a hot-dip metal plated steel strip manufacturing method and apparatus capable of effectively avoiding degradation in the quality of the steel strip resulting from adhesion of top dross floating in the region from the exit of support rolls to the surface of the plating bath.

The present invention in an embodiment relates to a method for manufacturing a hot-dip metal plated steel strip having a plated layer formed on an outer surface thereof comprising continuously immersing a steel strip in a bath tub that accommodates a molten metal plating bath, causing a sink roll disposed in the bath tub to change a traveling direction of the steel strip, then causing the steel strip to pass through two support rolls formed of a stabilizing roll and a correcting roll disposed above the sink roll but below a surface of the plating bath, and extracting the steel strip out of the bath, characterized in that a flow regulation plate is disposed so as to cover at least an upper side of a roll body of the stabilizing roll of the support rolls with a gap between the flow regulation plate and the stabilizing roll, and that a flow of the molten metal plating bath directed toward a portion of the steel strip located from an exit of the support rolls to the surface of the plating bath is led toward a lower side of the stabilizing roll via the gap. It is preferable that the gap has a gap dimension continuously or intermittently increasing from an entrance of the gap toward an exit thereof or a gap dimension continuously or intermittently increasing from the entrance of the gap toward a center thereof while continuously or intermittently decreasing from the portion where the gap dimension is increased toward the exit of the gap.

The present invention in an embodiment further relates to an apparatus for manufacturing a hot-dip metal plated steel strip having a plated layer formed on an outer surface thereof, the apparatus including a sink roll disposed in a bath tub that accommodates a molten metal plating bath and wherein the sink roll is configured to change a traveling direction of a steel strip continuously immersed in the bath tub, and two support rolls formed of a stabilizing roll and a correcting roll disposed above the sink roll but below a surface of the molten metal plating bath, the apparatus causing the steel strip traveling in a direction changed by the sink roll to pass through the support rolls and extracting the steel strip out of the bath. The apparatus is characterized by including a flow regulation plate having an inner wall along an outer surface of a roll body of the stabilizing roll out of the support rolls, the flow regulation plate having following dimensions: a size of a gap from the inner wall to the roll body of the stabilizing roll ranges from 5 to 60 mm; a separation distance in a horizontal direction from an upper front end of the flow regulation plate to a surface of the steel strip ranges from 50 to 100 mm; and a length over which the roll body of the stabilizing roll is covered over an angular range from 60 to 135° around a rotational center of the roll from the upper front end toward a bottom of the bath tub.

The present invention in an embodiment further relates to an apparatus for manufacturing a hot-dip metal plated steel strip having a plated layer formed on an outer surface thereof, the apparatus including a sink roll disposed in a bath tub that accommodates a molten metal plating bath and wherein the sink roll is configured to change a traveling direction of a steel strip continuously immersed in the bath tub, and two support rolls formed of a stabilizing roll and a correcting roll disposed above the sink roll but below a surface of the molten metal plating bath, the apparatus causing the steel strip traveling in a direction changed by the sink roll to pass through the support rolls and extracting the steel strip out of the bath. The apparatus is characterized by including a flow regulation plate having an inner wall along an outer surface of a roll body of the stabilizing roll out of the support rolls, the flow regulation plate having following dimensions: a size of a gab from the inner wall to the roll body of the stabilizing roll ranges from 10 to 40 mm; a separation distance in a horizontal direction from an upper front end of the flow regulation plate to a surface of the steel strip ranges from 50 to 100 mm; and a length over which the roll body of the stabilizing roll is covered over an angular range from 60 to 135° around a rotational center of the roll from the upper front end toward a bottom of the bath tub.

It is preferable that the gap has a gap dimension continuously or intermittently increasing from an entrance of the gap toward an exit thereof or a gap dimension continuously or intermittently increasing from the entrance of the gap toward a center thereof while continuously or intermittently decreasing from the portion where the gap dimension is increased toward the exit of the gap. The phrase "the gap dimension continuously increasing or decreasing" used herein means that the gap dimension gradually increases or decreases along the outer surface of the roll body of the stabilizing roll, and the phrase "the gap dimension intermittently increasing or decreasing" used herein means that the gap dimension stepwise (like steps) increases or decreases along the outer surface of the roll body of the stabilizing roll.

According to an embodiment of the present invention, the flow of the molten metal plating bath directed toward a portion of the steel strip that is located from the exit of the support rolls to the surface of the plating bath can be led by the flow regulation plate in such a way that the flow moves away from the steel strip, that is, toward the lower side of the stabilizing roll, whereby adhesion of top dross in the region can be suppressed. A tapered gap having a gap dimension continuously or intermittently increasing from the entrance of the gap toward the exit thereof or a mountain-shaped or crescent-shaped gap having a gap dimension continuously or intermittently increasing from the entrance of the gap toward the center thereof while continuously or intermittently decreasing from the center toward the exit of the gap allows dross in the vicinity of the steel strip in the plating bath to be efficiently removed. In particular, the mountain-shaped or crescent-shaped gap increases the flow speed of the molten metal plating bath located in the gap, whereby the dross in the vicinity of the steel strip is removed with increased efficiency.

DETAILED DESCRIPTION OF EMBODIMENTS OF THE INVENTION

The embodiments of the present invention will be more specifically described below with reference to the drawings.

Figure 1:
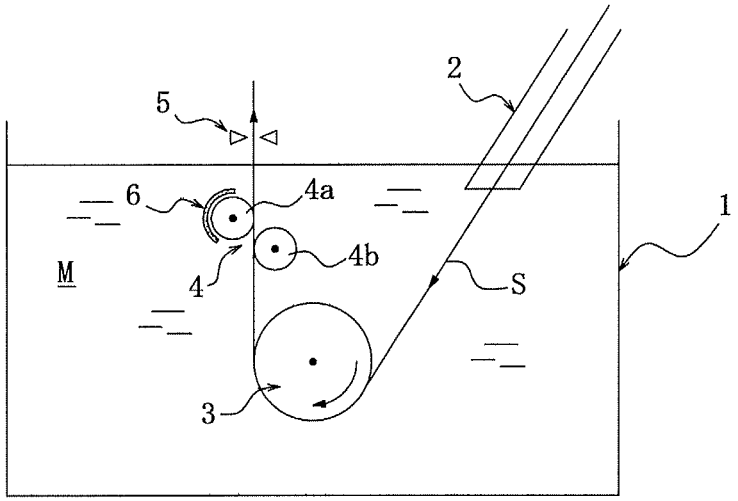
FIG. 1 is a schematic view (a side view) illustrating an embodiment of a manufacturing apparatus preferably used to implement the present invention.
Figure 2:
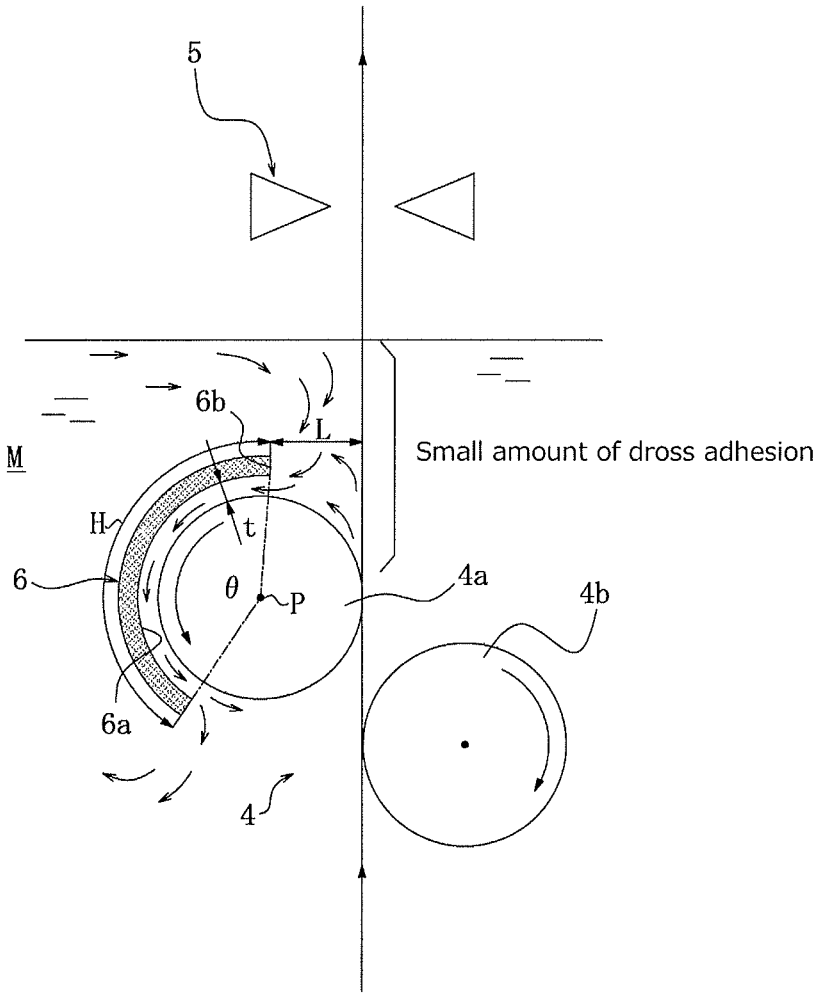
FIG. 2 is an enlarged view of main parts illustrating the manufacturing apparatus shown in FIG. 1.

FIG. 1 schematically illustrates (in the form of a cross section) an apparatus for manufacturing a hot-dip metal plated steel strip preferably used to implement an embodiment of the present invention, and FIG. 2 is an enlarged view of main parts of the apparatus shown in FIG. 1.

In FIG. 1, reference character 1 denotes a bath tub that accommodates a molten metal plating bath M, and reference character 2 denotes a snout that has a front end portion immersed in the plating bath and leads a steel strip S to be plated into the bath tub 1, and reference character 3 denotes a sink roll that is disposed in the bath tub 1 and changes the traveling direction of the steel strip S, and reference character 4 denotes support rolls that are disposed above the sink roll 3 but below the surface of the molten metal plating bath, guides the steel strip S, and corrects the shape thereof. The support rolls 4 are formed of two rolls, a stabilizing roll 4*a* ((upper) support roll closer to bath surface) and a correcting roll 4*b* ((lower) support roll farther from bath surface).

Reference character 5 is a wiping nozzle disposed above the surface of the molten metal plating bath so as to sandwich the steel strip S. The wiping nozzle 5 is located at the exit of the plating bath and has the function of spraying a gas onto the outer surface of the steel strip S and adjusting the thickness of the plated layer.

Reference character 6 is a flow regulation plate that covers at least the upper side of the stabilizing roll 4*a* with a gap t (see FIG. 2). The flow regulation plate 6 has an inner wall 6*a* formed along the outer surface of a roll body of the stabilizing roll 4*a* and has the following dimensions: the size of the gap t formed between the flow regulation plate 6 and the stabilizing roll 4*a* ranges from 5 to 60 mm; a separation distance L (see FIG. 2) in the horizontal direction from an upper front end 6*b* to the steel strip S ranges from 50 to 100 mm; and a length H (see FIG. 2), over which the roll body of the stabilizing roll 4*a* is covered over an angular range θ from 60 to 135° around a rotational center P of the roll 4*a* from the upper front end 6*b* toward the bottom of the bath tub 1. The flow regulation plate 6 is preferably as wide as the roll body of the roll 4*a* or wider than the roll body of the roll 4*a*. The flow regulation plate 6 only may be resistant to hot-dip zinc and is preferably made, for example, of SUS or ceramic coated steel material having a thickness of not less than 15 mm.

Figure 3:
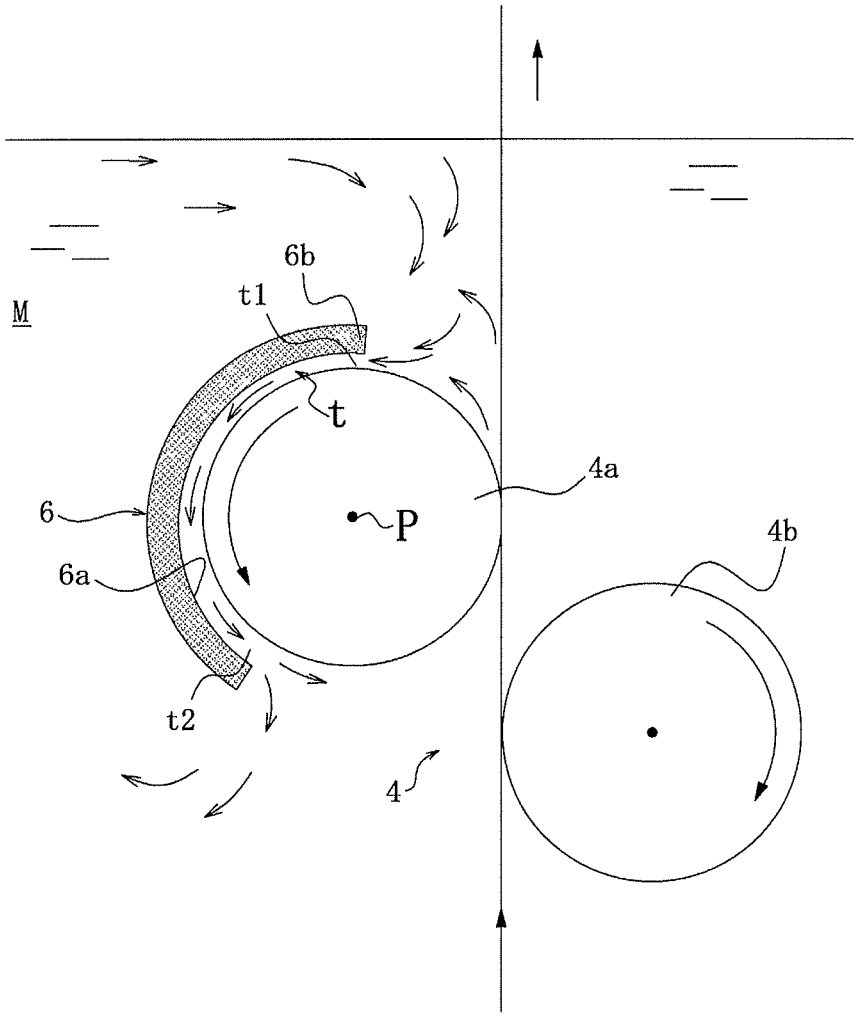
FIG. 3 is a schematic view illustrating an example of the cross-sectional shape of a gap.
Figure 4:
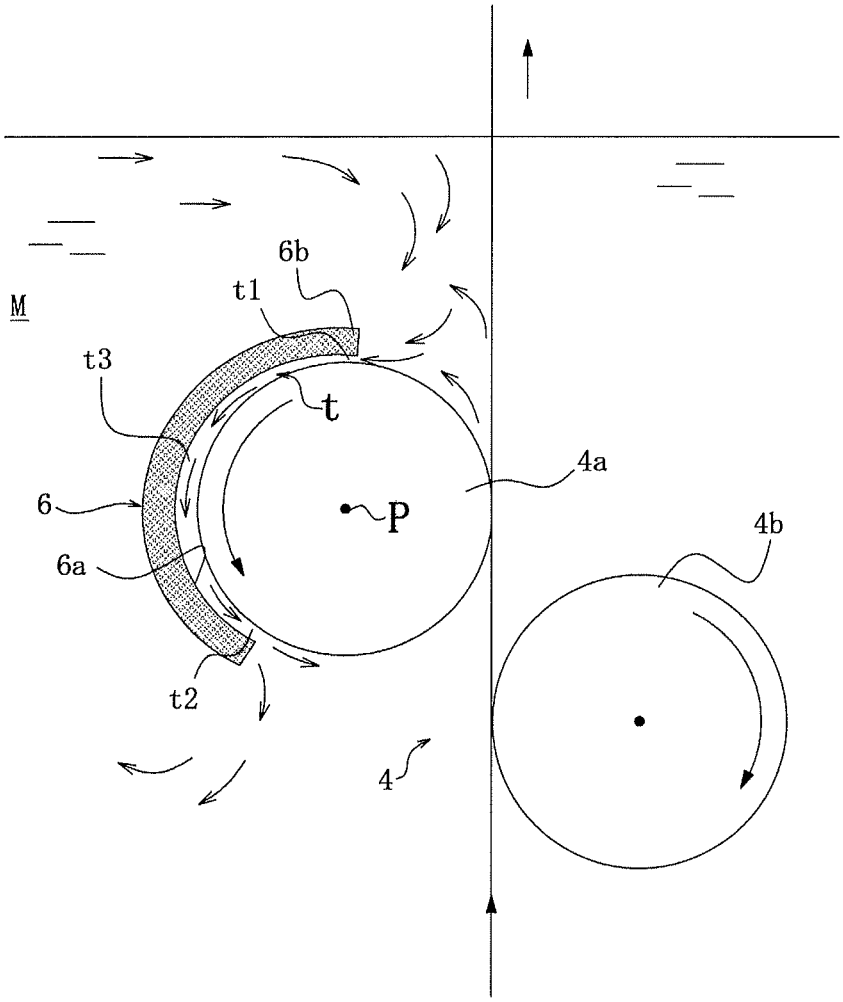
FIG. 4 is a schematic view illustrating another example of the cross-sectional shape of the gap.

The gap t is preferably, for example, the gap shown in FIG. 3, which has a gap dimension continuously or intermittently increasing from an entrance t1 of the gap t toward an exit t2 thereof, or the gap shown in FIG. 4, which has a gap dimension continuously or intermittently increasing from the entrance t1 of the gap t toward a center t3 thereof while continuously or intermittently decreasing from the center t3, where the gap dimension is maximized, toward the exit t2 of the gap t. The thus set gap t allows dross in the vicinity of the steel strip in the plating bath to be efficiently removed. It is noted that FIGS. 3 and 4 described above show an example of the gap t, and that the gap t does not necessarily have the shape shown in FIGS. 3 and 4. In particular, an apparatus having the gap t shown in FIG. 4 has a maximum gap dimension at the center t3 of the gap t, but the portion where the gap dimension is maximized may be shifted toward the entrance t1 or the exit t2 of the gap t.

Figure 5:
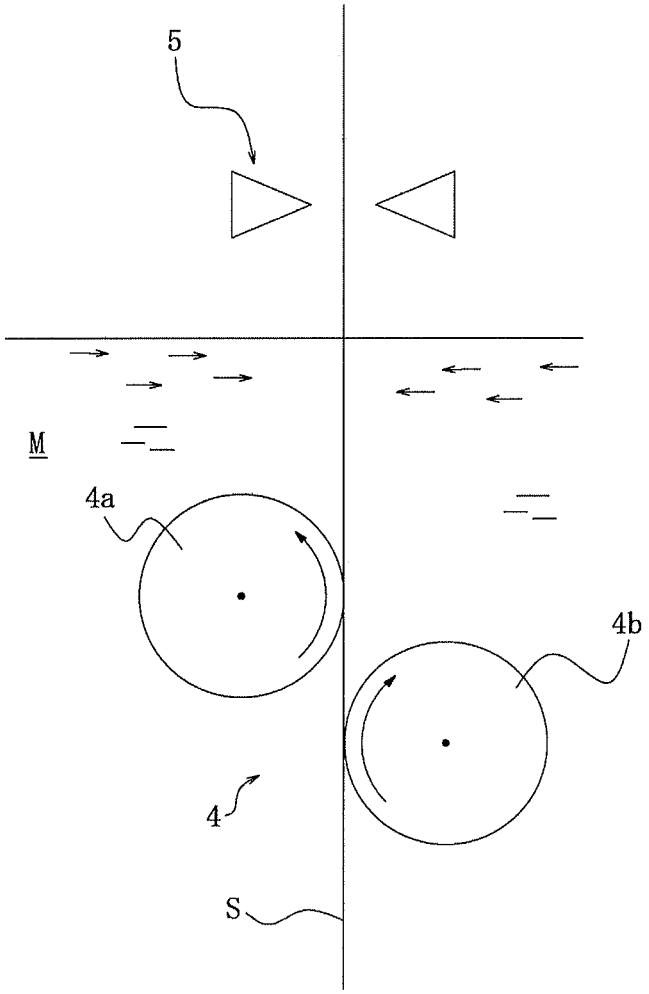
FIG. 5 is a view illustrating a state of the flow of a plating bath.
Figure 6:
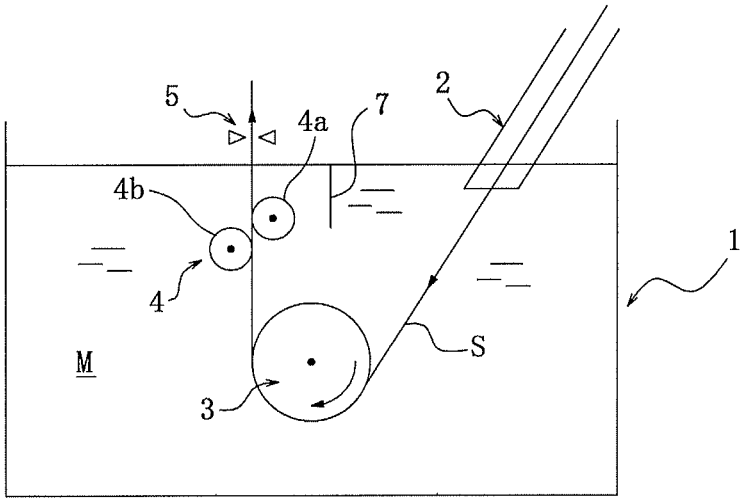
FIG. 6 a schematic view illustrating an example of a related-art apparatus for manufacturing a hot-dip metal plated steel strip.
Figure 7:
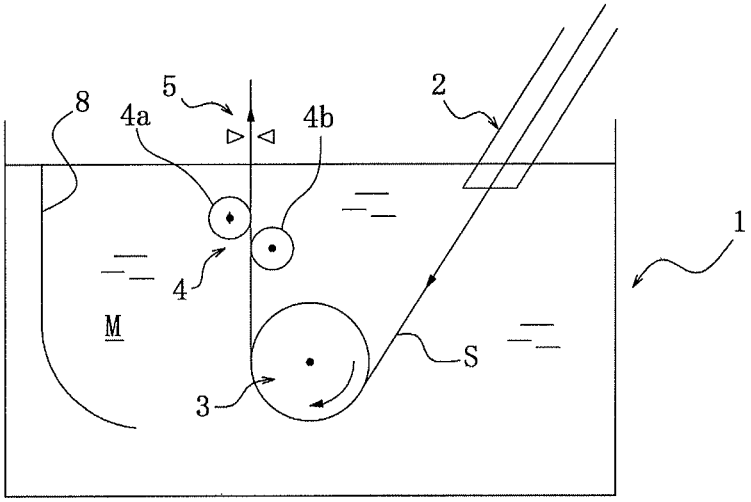
FIG. 7 is a schematic view illustrating another example of a related-art apparatus for manufacturing a hot-dip metal plated steel strip.

In a surface layer region of the plating bath, the plating bath typically flows toward the steel strip S (flows from the side facing the wall surface of the bath tub 1 toward the steel strip S), as shown in FIG. 5. Therefore, even in an apparatus in which a flow regulation plate 7 or 8 is disposed on the downstream side of the stabilizing roll 4*a* ((upper) support roll closer to the bath surface) (conventional apparatus) in the plating bath facing the roll 4*a*, as shown in FIG. 6 or 7, it is difficult to avoid adhesion of the top dross present in the region to the steel strip S. On the other hand, in the present invention, since the flow of the plating bath can be led toward the lower side of the stabilizing roll 4*a* via the gap t, as shown in FIG. 2, adhesion of the top dross to the steel strip S can be suppressed.

In an embodiment of the present invention, the gap t is set to a value ranging from 5 to 60 mm, the reason of which is that the gap t ranging from 5 to 60 mm allows the flow of the plating bath to be efficiently led to the entrance of the gap t. The gap t more preferably ranges from 10 to 40 mm.

Further, in an embodiment of the present invention, the separation distance L from the upper front end 6*b* of the flow regulation plate 6 to the surface of the steel strip S is set to a value ranging from 50 to 100 mm. The reason thereof is that the separation distance L ranging from 50 to 100 mm allows the flow of the plating bath to be smoothly introduced into the gap t. When the separation distance L exceeds 100 mm, the distance from the upper front end 6*b* to the steel strip S is too large, and it is therefore difficult to lead the dross into the gap t and the dross may undesirably be caught on the steel strip S, whereas when the separation distance L is less than 50 mm, the dross may adhere to the steel strip S when the dross is led into the gap t.

Further, in an embodiment of the present invention, the flow regulation plate 6 covers the roll body of the stabilizing roll 4*a* over the angular range from 60 to 135°. The reason thereof is that when the range over which the roll body of the stabilizing roll 4*a* is covered is less than 60°, the flow of the plating bath cannot be efficiently led to the lower side of the stabilizing roll 4*a*, whereas when the range over which the roll body of the stabilizing roll 4*a* is covered exceeds 135°, the flow of the plating bath reaches the steel strip S located below the stabilizing roll 4*a*, and the dross may be undesirably caught on the steel strip S.

The upper end of the immersed flow regulation plate 6 is preferably below the bath surface by not more than 10 mm so that surface layer flow is not hindered. The upper end of the immersed flow regulation plate 6 is also set in a position above the upper surface of the support rolls 4 (position close to liquid surface). The upper end of the immersed flow regulation plate 6 is automatically determined by the position where the stabilizing roll 4*a* of the support rolls 4 is disposed. For example, in the following conditions: the upper surface of the stabilizing roll 4*a* of the support rolls 4 is located in a position below the bath surface by a depth of 60 mm; the thickness of the flow regulation plate 6 is 10 mm; and the gap t is 10 mm, the upper end of the immersed flow regulation plate 6 is located in the position below the bath surface by a depth of 40 mm.

Figure 8:
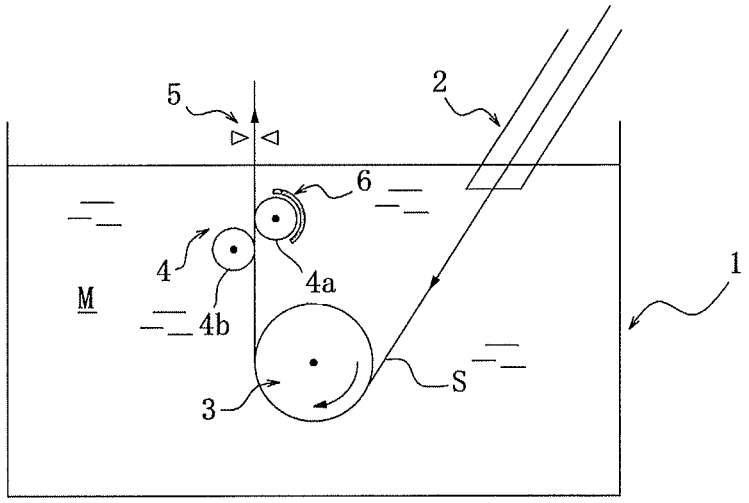
FIG. 8 is a schematic view illustrating another example of the manufacturing apparatus preferably used to implement an embodiment of the present invention.

The embodiment of the present invention is described with reference to the case where the stabilizing roll 4*a* is disposed on the rear side of the steel strip S (the same side as the steel strip in positional relationship between the sink roll and the steel strip) and the correcting roll 4*b* is disposed on the front side of the steel strip S (the same side as the sink roll in positional relationship between the sink roll and the steel strip). Alternatively, an apparatus shown in FIG. 8, in which the correcting roll 4*b* is disposed on the rear side of the steel strip S and the stabilizing roll 4*a* is disposed on the front side of the steel strip, can also be employed. Also in this case, the flow regulation plate 6 is provided along a part of the upper roll, that is, the stabilizing roll 4*a*.

EXAMPLES

Example 1

A cold-rolled steel strip having a width ranging from 800 to 1900 mm and a thickness ranging from 0.4 to 4.0 mm is placed in the manufacturing apparatus shown in FIG. 1 described above, in which a flow regulation plate is disposed in a setting condition shown in Table 1. Hot-dip galvanizing is performed on the cold-rolled steel strip under the following conditions: the bath temperature: 450 to 460° C.; the adhesion amount of plating: 45 to 90 g/m$^2$ per one side; and the linear speed: 60 to 150 mpm, and five sample material plates each having a size of 500 mm by 500 mm are collected from a hot-dip galvanized steel strip (coil) resulting from 300 tons of the processed cold-rolled steel strip. Hat-shape processing (punch diameter: 300 mm ϕ (R: 21 mm), wrinkle preventing pressure: 320 kN, punch speed: 320 mm/min, and product height: 27 mm) is performed on the five collected sample material plates. After the upper surface of each of the five resultant hat-shaped plates is ground with a #150 grindstone over one reciprocal motion, the number of foreign matter objects resulting from the dross is measured, and the number of foreign matter objects in the five hat-shaped plates were averaged. Table 1 shows the number of foreign matter objects per hat-shaped plate. The reason why the upper surface of each of the hat-shaped plates is ground is that the foreign matter objects is thus easily visually recognizable.

TABLE 1

| Number | Flow regulation plate: Upper end of immersed flow regulation plate (mm) | Gap t (mm) | Angle θ (°) | Separation distance L (mm) | Average number of foreign matter objects resulting from dross (number per hat-shaped plate) |
|---|---|---|---|---|---|
| 1 | — | — | — | — | 24.9 |
| 2 | 20 | 40 | 90 | 100 | 16.7 |
| 3 | 10 | 40 | 90 | 100 | 19.5 |
| 4 | 10 | 10 | 90 | 100 | 17.9 |
| 5 | 40 | 10 | 90 | 100 | 3.3 |
| 6 | 40 | 10 | 135 | 100 | 2.1 |
| 7 | 40 | 40 | 135 | 100 | 5.6 |
| 8 | 30 | 10 | 90 | 100 | 5.8 |
| 9 | 30 | 20 | 120 | 50 | 7.6 |
| 10 | 40 | 10 | 120 | 20 | 28.5 |
| 11 | 40 | 10 | 60 | 50 | 21.8 |
| 12 | 5 | 45 | 135 | 100 | 16.1 |
| 13 | 45 | 5 | 135 | 50 | 18.5 |
| 14 | 40 | 40 | 90 | 200 | 23.1 |
| 15 | 40 | 10 | 170 | 50 | 31.5 |
| 16 | 40 | 10 | 135 | 50 | 2.6 |

In the case where the steel strip is plated in accordance with the embodiments of the present invention, Table 1 shows that adhesion of dross is suppressed and a product having good quality can be manufactured.

Example 2

A manufacturing apparatus having a structure shown in FIG. 3 (upper end of immersed flow regulation plate: 10 mm, angle θ: 90°, and separation distance L: 100 mm) having a tapered gap having the gap dimension continuously increasing from the entrance to the exit of the gap (gap dimension at entrance t1: 10 mm, gap dimension at exit t2: 20 mm) and a manufacturing apparatus having a structure shown in FIG. 4 (upper end of immersed flow regulation plate: 40 mm, angle θ: 135°, and separation distance L: 100 mm) having a crescent-shaped gap having a gap dimension continuously increasing from the entrance to the center of the gap (gap dimension at entrance t1: 10 mm, gap dimension at center t3: 40 mm) and decreasing from the center to the exit of the gap (gap dimension at exit t2: 10 mm) are used to perform hot-dip galvanizing on the same cold-rolled steel strip as in Example 1, and the average number of foreign matter objects resulting from the dross is examined (the plating conditions and the examination conditions under which average number of foreign matter objects resulting from dross are the same as those in Example 1). As a result, in the case of the apparatus having the tapered gap, the average number (number per hat-shaped plate) of foreign matter objects resulting from the dross is 13.5, and the quality is further improved as compared with the number 4 in Table 1. In the case of the apparatus having the crescent-shaped gap, the average number of foreign matter objects resulting from the dross is 1.1, and the quality is further improved as compared with the number 6 in Table 1.

The present invention can provide a method and apparatus capable of manufacturing a hot-dip metal plated steel strip with surface defects resulting from adhesion of dross suppressed.

REFERENCE SIGNS LIST

1 bath tub
2 snout
3 sink roll
4 support roll
4*a* stabilizing roll
4*b* correcting roll
5 wiping nozzle
6 flow regulation plate
6*a* inner wall
6*b* upper front end
7 flow regulation plate
8 flow regulation plate
S steel strip

The invention claimed is:

1. A method for manufacturing a hot-dip metal plated steel strip having a plated layer formed on an outer surface thereof comprising:

continuously immersing a steel strip in a bath tub that accommodates a molten metal plating bath;

causing a sink roll disposed in the bath tub to change a traveling direction of the steel strip;

causing the steel strip to pass through two support rolls, wherein the two support rolls consist of a stabilizing roll, a correcting roll disposed above the sink roll but below a surface of the plating bath, and an entirety of a flow regulation plate, having an inner wall, is disposed along an outer surface of a roll body of the stabilizing roll, so as to cover at least an upper side of a roll body of the stabilizing roll with a gap between the flow regulation plate and the stabilizing roll;

and extracting the steel strip out of the bath, characterized in that a flow of the molten metal plating bath directed toward a portion of the steel strip located from an exit of the support rolls to the surface of the plating bath is led toward a lower side of the stabilizing roll via the gap.

2. The method for manufacturing a hot-dip metal plated steel strip according to claim 1, wherein the gap has a gap dimension continuously or intermittently increasing from an entrance of the gap toward an exit thereof.

3. The method for manufacturing a hot-dip metal plated steel strip according to claim 1, wherein the gap has a gap dimension continuously or intermittently increasing from an entrance of the gap toward a center thereof while continuously or intermittently decreasing from the portion where the gap dimension is increased toward the exit of the gap.

* * * * *